US012535262B2

(12) United States Patent
Nakamura et al.

(10) Patent No.: US 12,535,262 B2
(45) Date of Patent: Jan. 27, 2026

(54) REFRIGERATOR

(71) Applicant: Samsung Electronics Co., Ltd., Suwon-si (KR)

(72) Inventors: Hiroshi Nakamura, Yokohama (JP); Ryota Aoki, Yokohama (JP); Hitoshi Takase, Yokohama (JP); Tomohiko Matsuno, Yokohama (JP); Makoto Shibuya, Yokohama (JP)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 80 days.

(21) Appl. No.: 18/421,074

(22) Filed: Jan. 24, 2024

(65) Prior Publication Data

US 2024/0167755 A1 May 23, 2024

Related U.S. Application Data

(63) Continuation of application No. PCT/KR2022/008284, filed on Jun. 13, 2022.

(30) Foreign Application Priority Data

Aug. 10, 2021 (JP) ..... 2021-130845

(51) Int. Cl.
*F25D 23/02* (2006.01)
*F25D 23/04* (2006.01)

(52) U.S. Cl.
CPC ..... *F25D 23/028* (2013.01); *F25D 23/04* (2013.01)

(58) Field of Classification Search
CPC ..... F25D 23/028; F25D 23/04; F25D 23/066
(Continued)

(56) References Cited

U.S. PATENT DOCUMENTS 5,551,192 A * 9/1996 Avendano ..... F25D 23/087 312/405
8,240,091 B2 * 8/2012 Cittadini ..... F25D 23/087 49/478.1

(Continued)

FOREIGN PATENT DOCUMENTS

DE 10 2005 059 145 A1 6/2007
JP 52-49960 10/1950

(Continued)

OTHER PUBLICATIONS https://www.google.com/search?q=thermal+conductivity+of+aluminum+compared+to+vinyl+chloride&rlz=1C1GCEA_enUS1046US1047&oq=thermal+conductivity+of+aluminum+compared+to+vinyl+chloride&gs_lcrp=EgZjaHJvbWUyCQgAEEUYORigAdIBCTEzNDQ2ajBqMagCALACAA&sourceid=chrome&ie=UTF-8.*

(Continued)

*Primary Examiner* — Christopher Garft

(57) ABSTRACT

The disclosed refrigerator includes a compartment defined by a partition wall, a door configured to open and close the compartment, a sealing member on the door so that, when the compartment is closed by the door, the sealing member is between the compartment and the door and seals an inside of the compartment, an elastic member on the door or the compartment so that, when the compartment is closed by the door, the elastic member is between the compartment and the door and is further outside than the sealing member, and a heat transfer member in contact with the elastic member and configured so that, when the compartment is closed by the door, the heat transfer member transfers heat of outside air to the partition wall.

13 Claims, 11 Drawing Sheets

(58) Field of Classification Search
USPC ..... 312/405
See application file for complete search history.

(56) References Cited

U.S. PATENT DOCUMENTS

| | | | | |
|---|---|---|---|---|
| 9,080,808 | B2 | 7/2015 | Choi et al. | |
| 2008/0276540 | A1* | 11/2008 | Kim | F25D 23/087 49/478.1 |
| 2013/0014533 | A1 | 1/2013 | Choi et al. | |
| 2016/0123654 | A1 | 5/2016 | Lee et al. | |
| 2017/0130522 | A1* | 5/2017 | Lewan | F25D 23/028 |
| 2017/0292776 | A1* | 10/2017 | Kim | F25D 23/062 |
| 2018/0073799 | A1 | 3/2018 | Okazaki et al. | |
| 2018/0259244 | A1* | 9/2018 | Kim | F25D 23/028 |
| 2019/0078829 | A1 | 3/2019 | Okazaki et al. | |
| 2021/0404731 | A1* | 12/2021 | Caglin | F25D 23/087 |

FOREIGN PATENT DOCUMENTS

| | | |
|---|---|---|
| JP | 57-150778 | 3/1956 |
| JP | 2000-213853 | 8/2000 |
| JP | 2003-65652 | 3/2003 |
| JP | 2005-24204 | 1/2005 |
| JP | 2006-226582 | 8/2006 |
| JP | 2007-24348 | 2/2007 |
| JP | 2007-178032 | 7/2007 |
| JP | 2008-107045 | 5/2008 |
| JP | 2009-85454 | 4/2009 |
| JP | 2011-179765 | 9/2011 |
| JP | 2011-237115 | 11/2011 |
| JP | 2012-107770 | 6/2012 |
| JP | 2012-154564 | 8/2012 |
| JP | 5714303 | 5/2015 |
| JP | 2017-127352 | 7/2017 |
| JP | 2018-44758 | 3/2018 |
| JP | 2019-49389 | 3/2019 |
| JP | 6550983 | 7/2019 |
| JP | 2020-125889 | 8/2020 |
| JP | 7055240 | 4/2022 |
| KR | 10-1031132 | 4/2011 |
| KR | 10-2013-0009090 | 1/2013 |
| KR | 10-2016-0010038 | 1/2016 |
| KR | 10-1602270 | 3/2016 |
| KR | 10-2245368 | 4/2021 |
| KR | 10-2296461 | 9/2021 |
| WO | WO 2020/012526 | 1/2020 |

OTHER PUBLICATIONS

English Translation JP 2012-107770, Jun. 7, 2012, pp. 1-5.
Office Action dated Mar. 27, 2025, in Japanese Patent Application No. 2021-130845.
English translation of JP 52-49960 (Showa).

* cited by examiner

REFRIGERATOR

CROSS-REFERENCE TO RELATED APPLICATIONS

This is a continuation application of International Application No. PCT/KR2022/008284, filed Jun. 13, 2022, which is incorporated herein by reference in its entirety, it being further noted that foreign priority benefit is based upon Japanese Patent Application No. 2021-130845, filed Aug. 10, 2021, which is incorporated by reference herein in its entirety.

TECHNICAL FIELD

The disclosure relates to a refrigerator.

BACKGROUND ART

A problem with refrigerators is a condensation phenomenon that occurs when outside air entering a refrigerator through a door gap comes into contact with a partition unit because the partition unit is cooled by cold air inside the refrigerator.

According to Japanese Patent Laid-Open No. 2009-85454, condensation is prevented by heating the partition unit by supplying electricity to a condensation prevention heater and generating heat, or by heating the partition unit by flowing a high-pressure refrigerant of a refrigeration cycle to a hot pipe passing through the vicinity of the partition unit. However, in such a structure for preventing condensation by using a heater or hot pipe, problems such as an increase in manufacturing costs due to an increase in the number of parts and an increase in power consumption due to power consumed by the heater may occur.

DISCLOSURE

Technical Problem

The disclosure provides a refrigerator capable of preventing condensation without using a heater or hot pipe.

Technical Solution

According to an embodiment of the disclosure, a refrigerator includes a compartment defined by a partition wall, a door configured to open and close the compartment, a sealing member on the door so that, when the compartment is closed by the door, the sealing member is between the compartment and the door and seals an inside of the compartment, an elastic member on the door or the compartment so that, when the compartment is closed by the door, the elastic member is between the compartment and the door and is further outside than the sealing member, and a heat transfer member in contact with the elastic member and configured so that, when the compartment is closed by the door, the heat transfer member transfers heat of outside air to the partition wall.

In an embodiment of the disclosure, the heat transfer member may cover at least a part of an outer surface of the elastic member.

In an embodiment of the disclosure, the heat transfer member may cover at least a part of an outer surface of the elastic member that is in contact with the outside air.

In an embodiment of the disclosure, the heat transfer member may entirely cover an outer surface of the elastic member.

In an embodiment of the disclosure, the heat transfer member may be located inside the elastic member.

In an embodiment of the disclosure, the elastic member may include a plurality of division elements, and the heat transfer member may cover a surface of at least one division element of the plurality of division elements.

In an embodiment of the disclosure, the plurality of division elements may form a layered structure.

In an embodiment of the disclosure, layer distances of the layered structure are narrower on an outside than an inside of the compartment.

In an embodiment of the disclosure, when the compartment is closed by the door, the heat transfer member may be in close contact with the door and the partition wall.

In an embodiment of the disclosure, the refrigerator may further include a pocket member including an inner air layer and accommodating the elastic member and the heat transfer member.

In an embodiment of the disclosure, when the compartment is closed by the door, the pocket member may be in close contact with the door and the partition wall.

In an embodiment of the disclosure, the pocket member may be integrally formed with the sealing member.

In an embodiment of the disclosure, a fixing mechanism may fix the pocket member to one of the door and the partition wall.

In an embodiment of the disclosure, the refrigerator may further include a second heat transfer member inside the door and configured to transfer the heat of the outside air to the heat transfer member.

In an embodiment of the disclosure, a heat conductivity of the heat transfer member may be 100 times or greater than a heat conductivity of the sealing member.

Advantageous Effects

According to the embodiments of the refrigerator described above, a condensation prevention effect may be achieved with a simple structure. In addition, condensation may be prevented without increasing power consumption. The condensation prevention effect may be achieved without using a heater or hot pipe.

MODE FOR INVENTION

Figure 1:
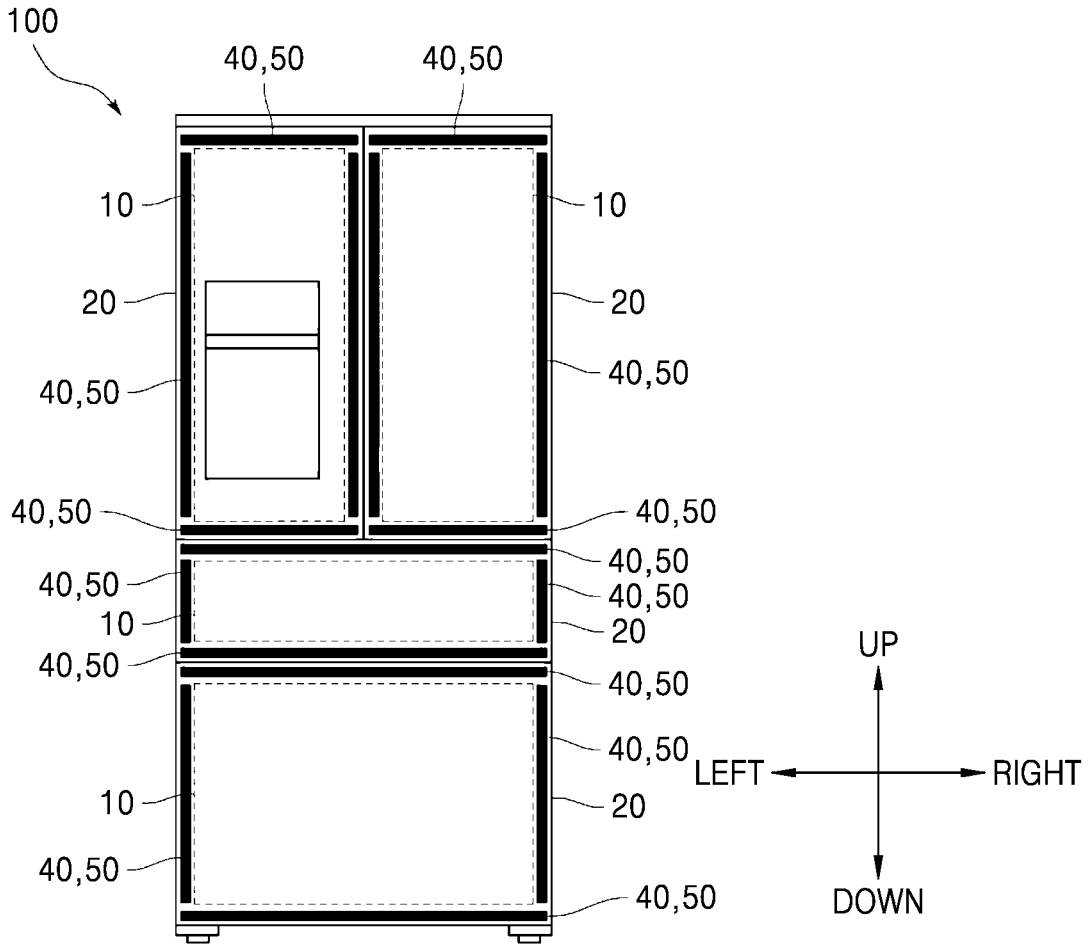
FIG. 1 is a schematic diagram of a refrigerator according to an embodiment of the disclosure.

All terms including descriptive or technical terms which are used herein should be construed as having meanings that are obvious to one of ordinary skill in the art. However, the terms may have different meanings according to the intention of one of ordinary skill in the art, precedent cases, or the appearance of new technologies. Also, some terms may be arbitrarily selected by the applicant, and in this case, the meaning of the selected terms will be described in detail in the detailed description of the disclosure. Thus, the terms used herein have to be defined based on the meaning of the terms together with the description throughout the specification. When a part "includes" or "comprises" an element, unless there is a particular description contrary thereto, the part may further include other elements, not excluding the other elements.

Hereinafter, embodiments of the disclosure will be described in detail with reference to the accompanying drawings such that one of ordinary skill in the art may easily implement the embodiments of the disclosure. However, the embodiments of the disclosure may be implemented in many different forms and are not limited to those described herein. In the drawings, components not related to the description are omitted for clear description of the disclosure, and like reference numerals in the drawings denote like or similar elements throughout the specification. Hereinafter, a refrigerator according to embodiments of the disclosure will be described with reference to the drawings.

Figure 2:
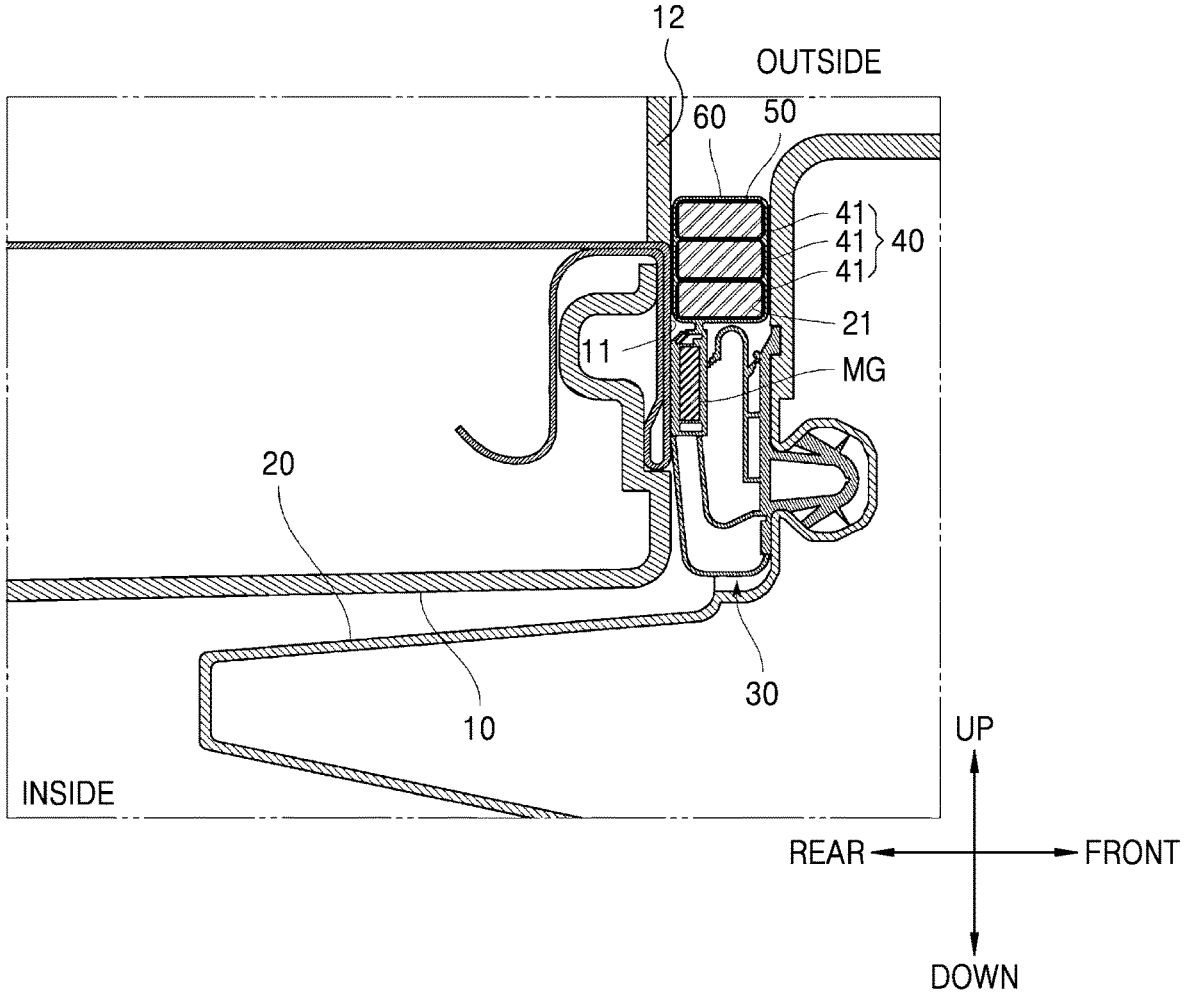
FIG. 2 is a schematic cross-sectional view of a condensation prevention structure according to an embodiment.

FIG. 1 is a schematic diagram of a refrigerator 100 according to an embodiment of the disclosure. FIG. 2 is a schematic cross-sectional view of a condensation prevention structure according to an embodiment. Referring to FIGS. 1 and 2, the refrigerator 100 according to an embodiment of the disclosure may include a plurality of compartments 10 and a plurality of doors 20 respectively installed with respect to the plurality of compartments 10. Inner spaces of the plurality of compartments 10 may be partitioned in an up and down direction and/or transverse direction. The plurality of compartments 10 may include, for example, a refrigerating compartment, a freezing compartment, a vegetable compartment, an ice-making compartment, etc. An inner space of the refrigerator 100 may be partitioned into the plurality of compartments 10 by a partition unit, for example, a partition wall 12. The compartment 10 may, for example, be in the shape of a box having an opening. The compartment 10 may be in the form of a box that is long in the up and down direction or in the shape of a box that is long in a left and right direction. For example, the compartment 10 may be in the shape of a box with one side open. The door 20 opens and closes an open one side of the compartment 10. The door 20 may be, for example, a sliding or swinging type, and may be a single door type or a double door type.

A sealing member 30 is disposed between the compartment 10 and the door 20. The sealing member 30 seals the inside of the compartment 10 when the door 10 is closed. As shown in FIG. 2, the sealing member 30 is disposed between the compartment 10 and the door 20 when the opening of the compartment 10 is closed by the door 20. The sealing member 30 may be, for example, a gasket including a magnet MG. The sealing member 30 is mounted on an inner surface 21 of the door 20, and is attached to an outer surface 11 of the compartment 10 by a magnetic force when the door 20 is closed. The sealing member 30 may be a member having a long length extending in a width direction (left and right direction) of the door 20. The sealing member 30 may be a member having a long length extending in a height direction (up and down direction) of the door 20.

The refrigerator 100 has the condensation prevention structure. The condensation prevention member of the embodiment prevents condensation by transferring heat of outside air to the partition unit, for example, the partition wall 12. Referring to FIG. 2, the condensation prevention member according to an embodiment may include an elastic member 40 and a heat transfer member 50. The elastic member 40 and the heat transfer member 50 are disposed between the compartment 10 and the door 20. The elastic member 40 and the heat transfer member 50 may be installed in any one of the compartment 10 and the door 20. The elastic member 40 may be located further outside than the sealing member 30 when the door 20 is closed. The heat transfer member 50 may be located around the elastic member 40. At least a part of the heat transfer member 50 is in contact with the elastic member 40 and transfers heat from the outside of the refrigerator 100, for example, heat of outside air, to the partition unit, for example, the partition wall 12.

The elastic member 40 may have an elastic force so as to be compressed by being pressed between the compartment 10 and the door 20 when the door 20 is closed, and be restored to its original state when the door 20 is opened. As an example, the elastic member 40 may include an elastic material including open-foams, such as a resin soft sponge.

As shown in FIG. 1, the elastic member 40 may be in the shape having a long length extending in the width direction (left and right direction of the refrigerator 100) and the height direction (up and down direction of the refrigerator 100) of the door 20. The elastic member 40 may be disposed opposite to the partition unit, for example, the partition wall 12, partitioning at least the interior of the refrigerator 100 into the plurality of compartments 10 that are adjacent to each other. In addition, the elastic member 40 may be disposed at a position that does not face the partition unit, for example, along an upper or lower side of the door 20.

Figure 3:
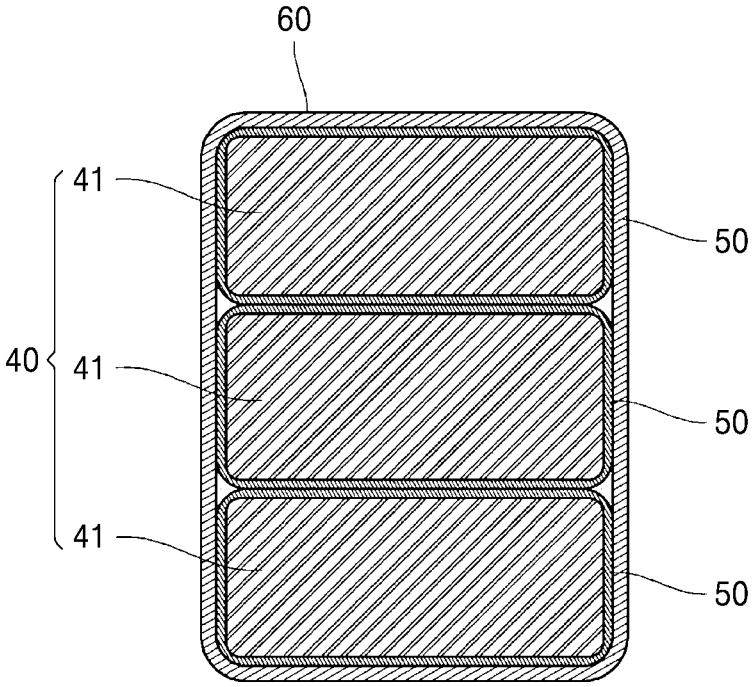
FIG. 3 is a cross-sectional view of an elastic member and a heat transfer member, according to an embodiment.
Figure 4:
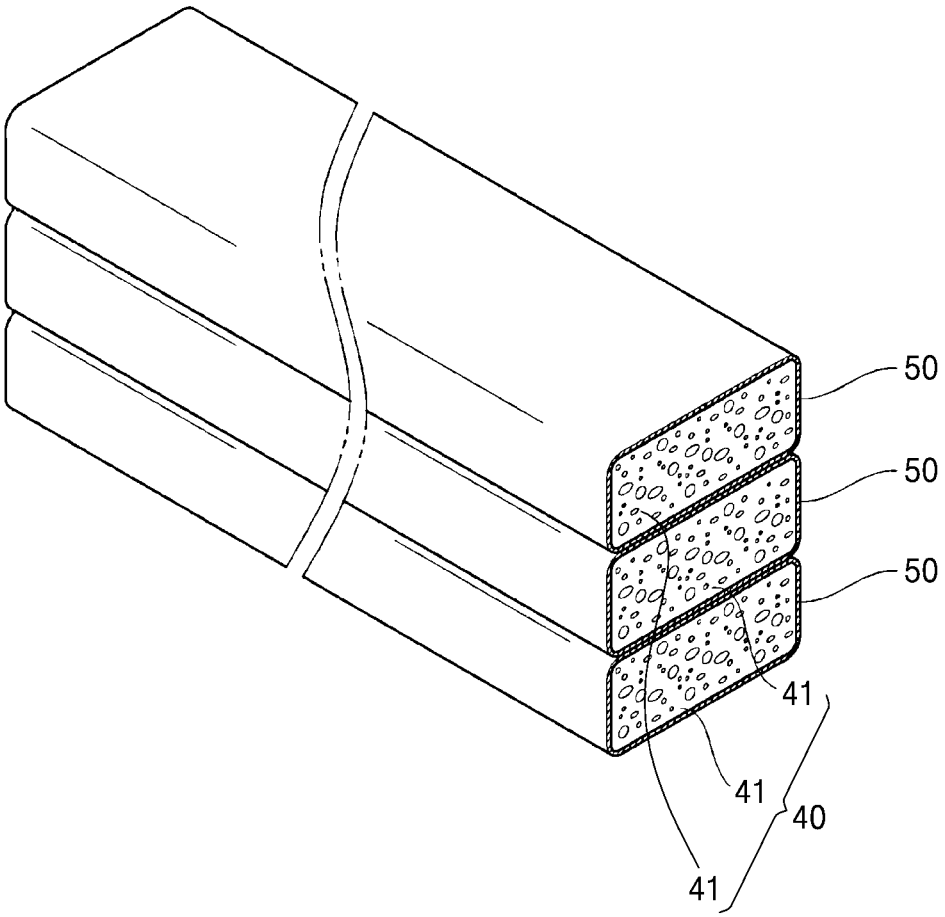
FIG. 4 is a perspective view of the elastic member and the heat transfer member, according to an embodiment.

FIG. 3 is a cross-sectional view of the elastic member 40 and the heat transfer member 50 according to an embodiment. FIG. 4 is a perspective view of the elastic member 40 and the heat transfer member 50 according to an embodiment. Referring to FIGS. 2 to 4, in an embodiment, the elastic member 40 may include a plurality of division elements 41.

For example, each of the plurality of division elements 41 may be a flat plate shape having a long length extending in the width or height direction of the door 20. The elastic member 40 may be implemented by stacking the plurality of division elements 41 in a thickness direction and forming a layered structure. The shapes of the plurality of division elements 41 may be the same, and at least one of the plurality of division elements 41 may have a different shape.

The embodiment of the elastic member 40 is not limited to the examples shown in FIGS. 2 to 4. The elastic member 40 does not necessarily have the layered structure. The elastic member 40 may not be divided into the plurality of division elements 41 but may be a single piece.

As shown in FIG. 2, the heat transfer member 50, which transfers heat outside the refrigerator 100 to the sealing member 30 described above or a partition unit, for example, the partition wall 12, may include a material having a greater thermal conductivity than at least the sealing member 30 or the elastic member 40. For example, the thermal conductivity of the heat transfer member 50 may be 100 times or greater than the thermal conductivity of the sealing member 30.

In addition to thermal conductivity, the heat transfer member 50 may have deformable elasticity together with the elastic member 40. The heat transfer member 50 may cover at least a part of an outer surface of the elastic member 40. The heat transfer member 50 may cover at least a part of the outer surface of the elastic member 40 that is in contact with outside air. The heat transfer member 50 may entirely cover the outer surface of the elastic member 40. The heat transfer member 50 may be located inside the elastic member 40.

As shown in FIGS. 2 to 4, the heat transfer member 50 may cover, for example, the outer surface of the elastic member 40. The heat transfer member 50 may be a thin member such as a sheet. The heat transfer member 50 may be in close contact with each of the door 20 and the partition wall 12 defining the compartment 10 when the door 20 is closed. In other words, the heat transfer member 50 may be in close contact with both the inner surface 21 of the door 20 and the outer surface 11 of the compartment 10.

As the heat transfer member 50, for example, a metal foil, a graphite sheet, etc. may be employed. As an example, an aluminum foil may be used to cover substantially the entire outer surface of the elastic member 40. As an example, the heat transfer member 50 may be implemented with a heat conductive paint coated in a film shape on the outer surface of the elastic member 40.

As shown in FIG. 1, like the elastic member 40 described above, the heat transfer member 50 may be in the shape having a long length extending in the width direction (left and right direction of the refrigerator 100) and the height direction (up and down direction of the refrigerator 100) of the door 20. The heat transfer member 50 may be disposed opposite to the partition unit, for example, the partition wall 12, partitioning at least the interior of the refrigerator 100 into the plurality of compartments 10 that are adjacent to each other. In addition, the heat transfer member 50 may be disposed at a position that does not face the partition unit, for example, along an upper or lower side of the door 20.

As described above, when the elastic member 40 includes the plurality of division elements 41, the heat transfer member 50 may be disposed around each of the plurality of division elements 41. That is, the heat transfer member 50 may cover an outer surface of each of the plurality of division elements 41, as shown in FIGS. 3 and 4. As a result, the thin heat transfer member 50 is disposed in a double-overlapping state between the two adjacent division elements 41.

Referring to FIGS. 2 and 3, the condensation prevention structure according to an embodiment may include a pocket member 60 having an inner air layer. The pocket member 60 accommodates the elastic member 40 and the heat transfer member 50.

The pocket member 60 may include, for example, an elastically deformable resin. The pocket member 60 may be integrated with the sealing member 30. The pocket member 60 may be a separate from the sealing member 30. The pocket member 60 may be in close contact with each of the door 20 and the partition wall 12 defining the compartment 10 when the door 20 is closed. The pocket member 60 may include a material having thermal conductivity material and may be thin to minimize degradation of heat transfer efficiency.

According to this configuration, the elastic member 40 is disposed further outside than the sealing member 30 between the compartment 10 and the door 20, and the heat transfer member 50 is installed around the elastic member 40. Through the heat transfer member 50, heat (heat of outside air) outside the refrigerator 100 may be transferred to the partition unit, for example, the partition wall 12, where condensation is likely to occur. Accordingly, condensation may be prevented without using a heater or hot pipe. The heat transfer member 50 is in close contact with each of the compartment 10 and the door 20 when the door 20 is closed, and thus, heat of outside air may be effectively transferred to the compartment 10. The heat transfer member 50 extends along the sealing member 30, and thus, condensation may be prevented over a wide area in the width direction or height direction of the door 20.

In addition, the heat transfer member 50 is disposed around the elastic member 40, and the elastic member 40 is compressed by being pressed when the door 20 is closed, and thus, even though there is a manufacturing error in the compartment 10 or the door 20, the heat transfer member 50 may be in stably contact with the partition unit, for example, the partition wall 12, and the door 10. Accordingly, heat transfer of the heat transfer member 50 may be stably performed.

The elastic member 40 including the plurality of stacked division elements 41 is more easily manufactured than a single piece of integrally elastic member. For example, the plurality of division elements 41 may have greater dimensional stability during manufacture than the single piece of elastic member.

The heat transfer member 50 is a thin member such as a metal foil or sheet, and thus, the heat transfer member 50 may also be deformed without difficulty according to deformation of the elastic member 40. Accordingly, the heat transfer member 50 may be in securely contact with the partition unit, for example, the partition wall 12 and the door 10.

The elastic member 40 includes the plurality of division elements 41, and the heat transfer member 50 covers each of the plurality of division elements 41, and thus, many heat transfer paths may be formed, and heat of outside air may be efficiently transferred to the partition unit, for example, the partition wall 12, where condensation is likely to occur, compared to a structure in which the heat transfer member 50 covers the single piece of elastic member 40.

The elastic member 40 includes an elastic material including open-foams, and thus, the elastic member 40 may be more smoothly elastically deformed and restore than an elastic material including independent (closed)-foams. Accordingly, the heat transfer member 50 may be stably and closely adhered to the compartment 10 and the door 20. The elastic member 40 and the heat transfer member 50 are installed to respectively correspond to the plurality of doors 20, and thus, condensation may be prevented from each of the plurality of doors 20. In addition, according to a structure in which the elastic member 40 and the heat transfer member 50 are accommodated in the pocket member 60, the elastic member 40 and the heat transfer member 50 may be integrally treated with the pocket member 60. Therefore, handling, assemblability, etc. may be improved. In addition, the pocket member 60 is in close contact with each of the compartments 10 and the door 20 when the door 20 is closed, and thus, heat outside the refrigerator 100 may be efficiently transferred to the partition unit, for example, the partition wall 12, etc.

Figure 5A:
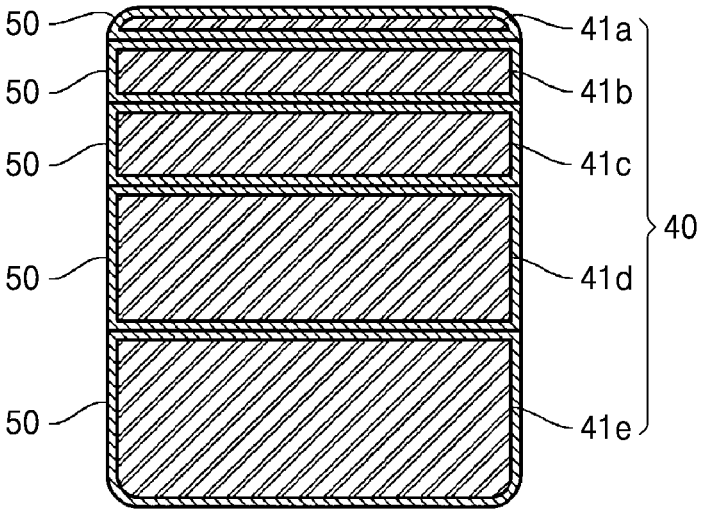
FIGS. 5A and 5B are schematic cross-sectional views of the elastic member and the heat transfer member, according to embodiments.
Figure 5B:
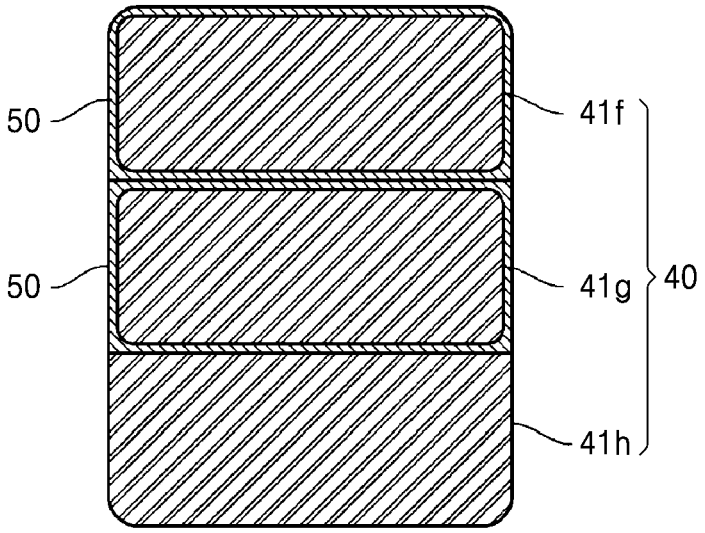

The shape of the elastic member 40 is not limited to the above-described embodiment. For example, in the above-described embodiment, the plurality of division elements 41 have the same shape, but some or all of the plurality of division elements 41 may have different shapes. FIGS. 5A and 5B are schematic cross-sectional views of the elastic member 40 and the heat transfer member 50 according to embodiments.

Referring to FIG. 5A, the elastic member 40 may include a plurality of division elements 41*a*, 41*b*, 41*c*, 41*d*, and 41*e* having different thicknesses. The elastic member 40 may be formed by stacking the plurality of division elements 41*a*, 41*b*, 41*c*, 41*d*, and 41*e* having different thicknesses in the thickness direction and forming a layered structure. The elastic member 40 may be disposed between the compartment 10 and the door 20 in the thickness direction or the width direction. Layer distances of the layered structure, in other words, distances between the plurality of heat transfer members 50 respectively covering outer surfaces of the division elements 41, may be narrower on an outside than on an inside of the compartment 10. For example, as shown in FIG. 5A, the elastic member 40 may be disposed such that among the plurality of division elements 41*a*, 41*b*, 41*c*, 41*d*, and 41*e*, the division element 41*a* having a smaller thickness faces outside and the division element 41*e* having a greater thickness faces inside. According to this configuration, the distances between the plurality of heat transfer members 50 respectively covering the outer surfaces of the plurality of division elements 41*a*, 41*b*, 41*c*, 41*d*, and 41*e* may be densely disposed outside the refrigerator 100, thereby improving heat transfer efficiency.

The heat transfer member 50 does not necessarily cover the entire outer surface of the elastic member 40. For example, referring to FIG. 5B, the heat transfer member 50 may cover a part of the outer surface of the elastic member 40. In this case, the heat transfer member 50 may cover at least a part of the outer surface of the elastic member 40 facing the compartment 10. When the elastic member 40 includes a plurality of division elements 41*f*, 41*g*, and 41*h*, the heat transfer member 50 may be disposed on at least an outer surface of the division element 41*f* disposed outside.

Figure 6:
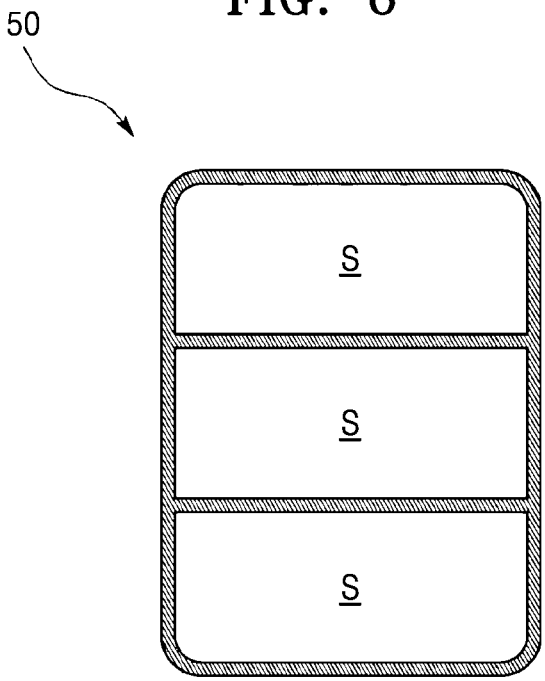
FIG. 6 is a schematic cross-sectional view of the heat transfer member according to an embodiment.

The shape of the heat transfer member 50 is not limited to the thin shape described above. FIG. 6 is a schematic cross-sectional view of the heat transfer member 60 according to an embodiment. Referring to FIG. 6, the heat transfer member 50 may be formed by processing, for example, a thin plate-shaped metal into a three-dimensional shape. In this case, rigidity of the heat transfer member 50 is greater than that of a thin heat transfer member, and thus, the inside of the heat transfer member 50 may be a cavity S. In this case, air layers filled in the cavity S may function as the elastic member 40.

Figure 7A:
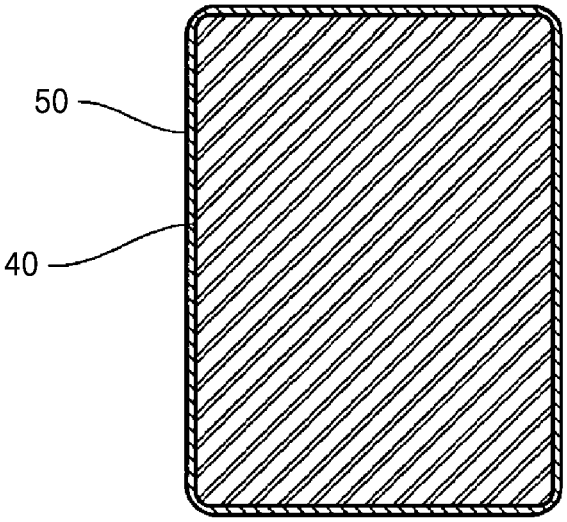
FIGS. 7A to 7C are schematic cross-sectional views of the elastic member and the heat transfer member, according to embodiments.
Figure 7B:
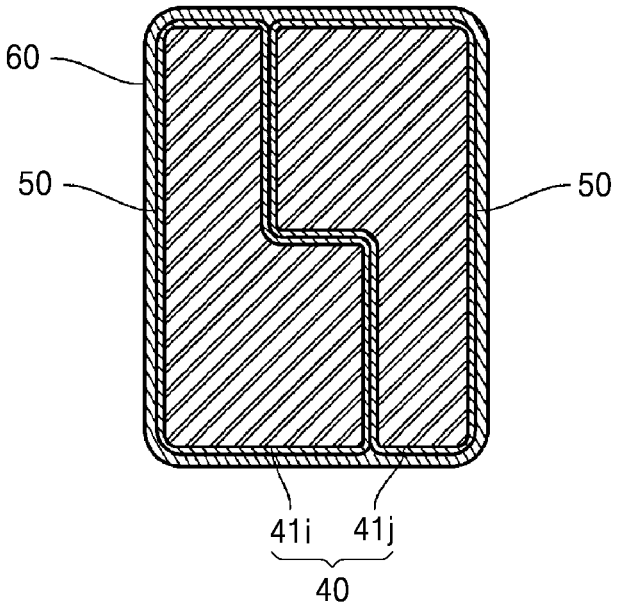
Figure 7C:
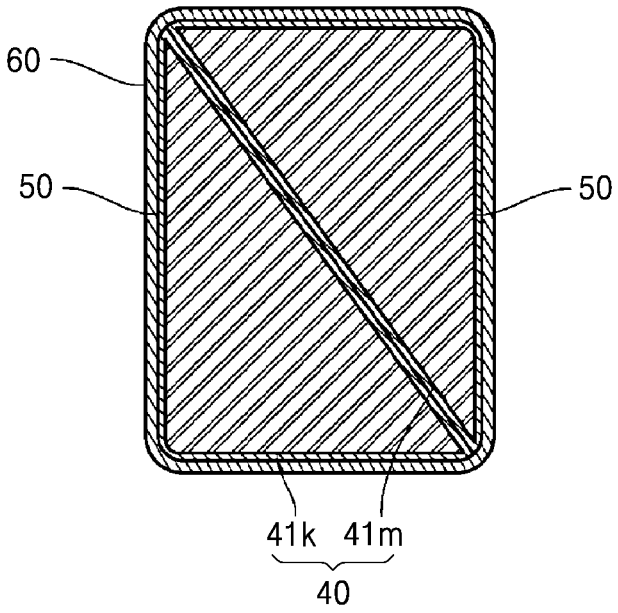

The shape of the elastic member 40 may vary. FIGS. 7A to 7C are schematic cross-sectional views of the elastic member 40 and the heat transfer member 50 according to embodiments. Referring to FIG. 7A, the elastic member 40 may be in the form of a single piece without a division element. Referring to FIG. 7B, the elastic member 40 may include two stepped division elements 41*i* and 41*j*. Referring to FIG. 7C, the elastic member 40 may include two triangular division elements 41*k* and 41*m*. In addition, the elastic member 40 may be a single piece of various shapes. In addition, the elastic member 40 may include a plurality of division elements of various shapes. In the above-described embodiment, the pocket member 60 accommodating the elastic member 40 and the heat transfer member 50 is integrally formed with the sealing member 30, but the pocket member 60 may be a separate from the sealing member 30. In this case, the pocket member 60 may be fixed to the compartment 10 or the door 20 by a fixing mechanism.

Figure 8:
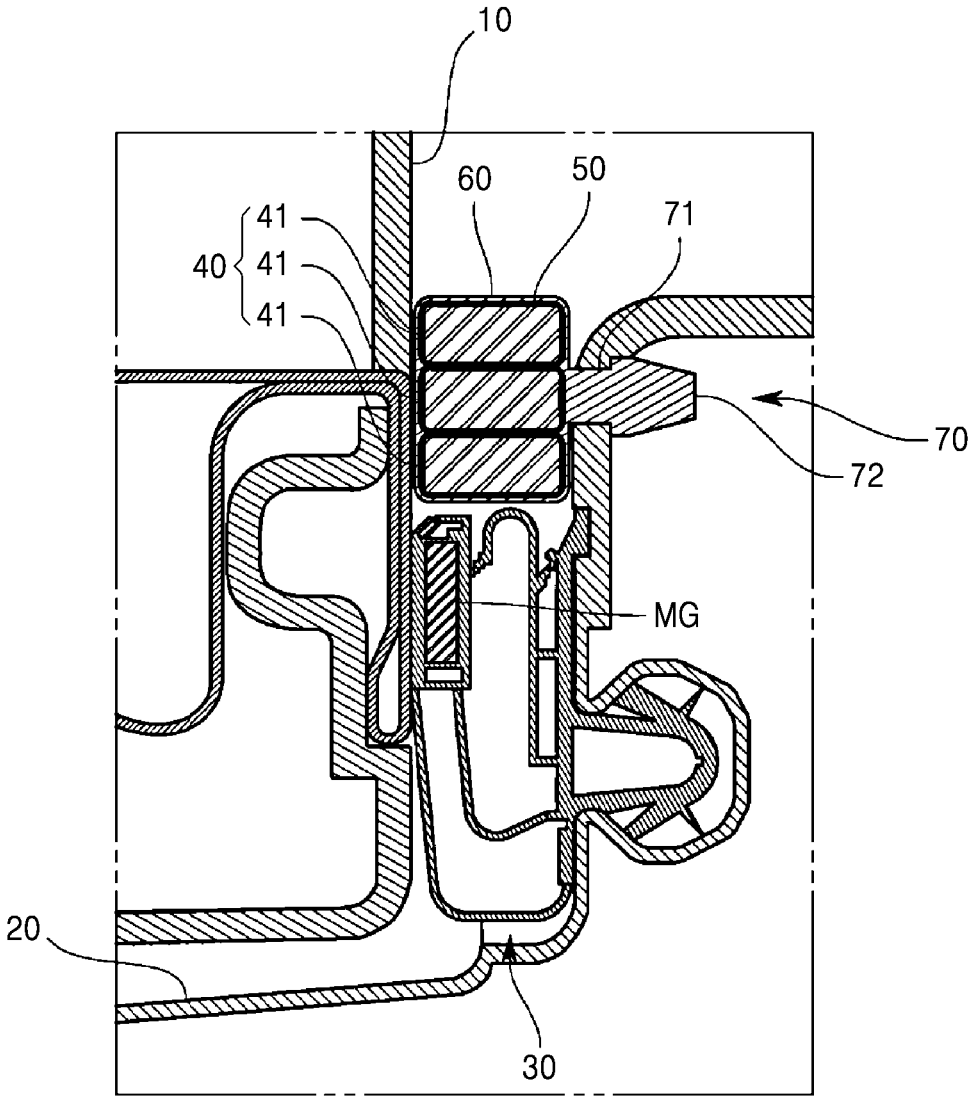
FIG. 8 is a schematic cross-sectional view of a fixing mechanism fixing a pocket member, according to an embodiment.

FIG. 8 is a schematic cross-sectional view of a fixing mechanism 70 fixing the pocket member 60 according to an embodiment. Referring to FIG. 8, the pocket member 80 may be mounted on the door 20. In this case, the refrigerator 100 may include the fixing mechanism 70 fixing the pocket member 60 to the door 20. For example, the fixing mechanism 70 may include a recessed portion 71 provided in one side of the pocket member 60 and the door 20, and a convex portion 72 provided on the other side of the pocket member 60 and the door 20 and engaged into the recessed portion 71. For example, the concave portion 71 may be in the shape of a through hole, and the convex portion 72 may be in a shape that may be elastically inserted into the through hole.

Figure 9:
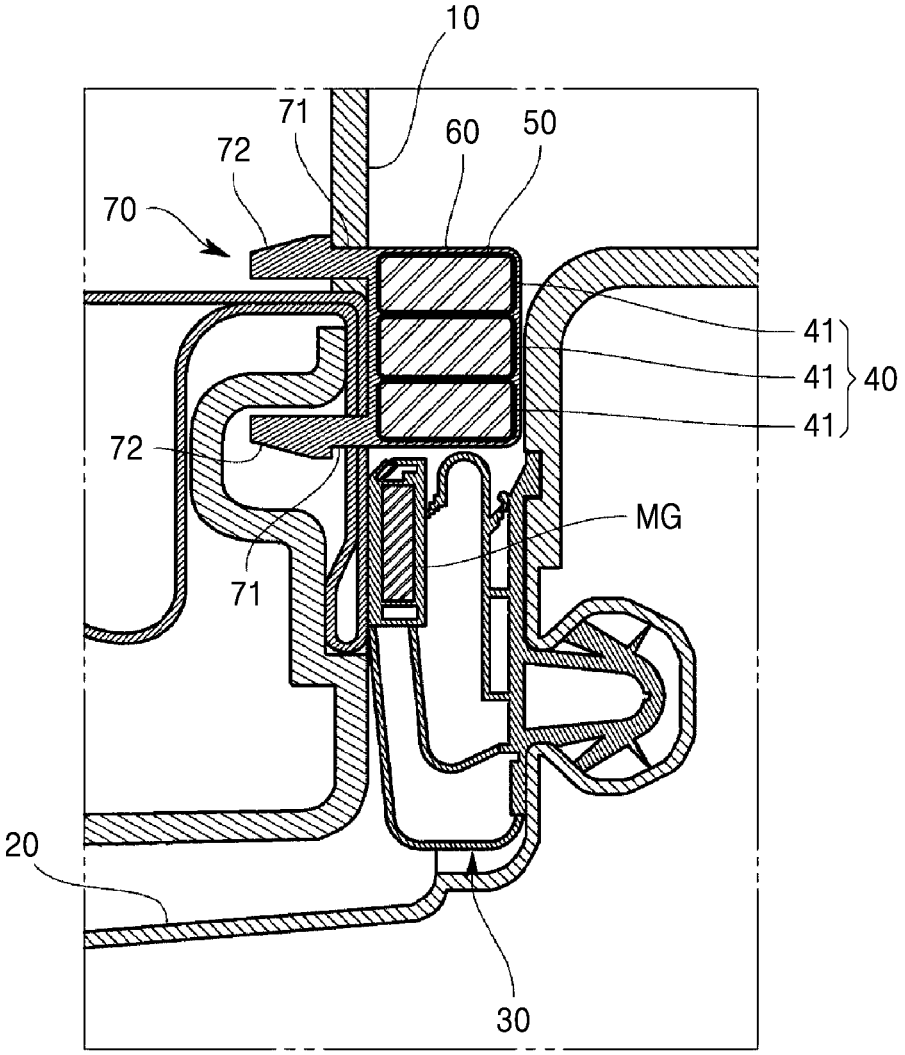
FIG. 9 is a schematic cross-sectional view of the fixing mechanism fixing the pocket member, according to an embodiment.

FIG. 9 is a schematic cross-sectional view of the fixing mechanism 70 fixing the pocket member 80 according to an embodiment. Referring to FIG. 9, the pocket member 60 may be mounted in the compartment 10. In this case, similar to the case where the pocket member 60 is mounted in the door 20, the refrigerator 100 may include the fixing mechanism 70 fixing the pocket member 60 to the compartment 10. For example, as described above the fixing mechanism 70 may include the recessed portion 71 installed in one side of the pocket member 60 and the door 20, and the convex portion 72 installed on the other side of the pocket member 60 and the door 20 and engaged into the recessed portion 71. For example, the concave portion 71 may be in the shape of a through hole, and the convex portion 72 may be in a shape that may be elastically inserted into the through hole.

Figure 10:
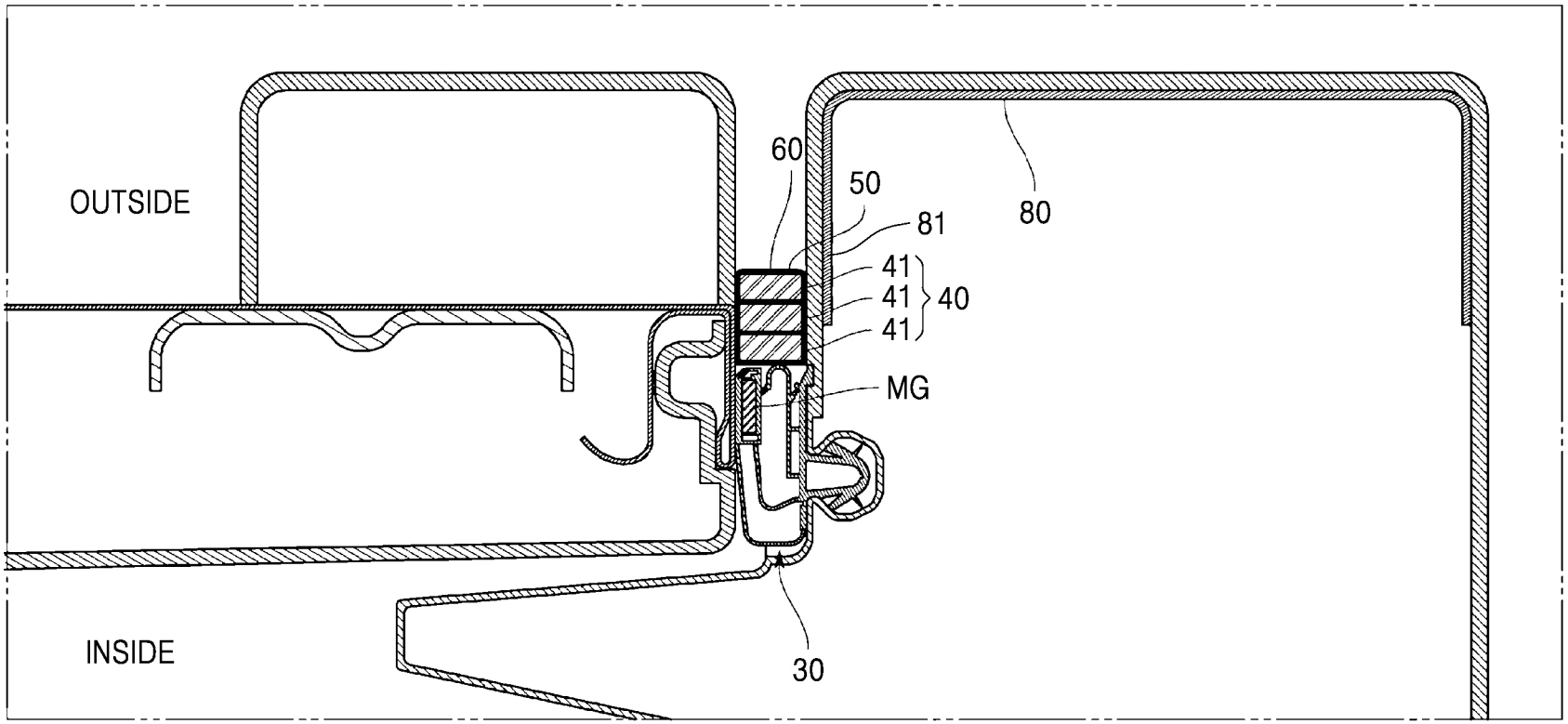
FIG. 10 is a schematic cross-sectional view of the condensation prevention structure according to an embodiment.

FIG. 10 is a schematic cross-sectional view of a condensation prevention structure according to an embodiment. The condensation prevention structure of the embodiment is different from the above-described embodiments of the condensation prevention structure in that a second heat transfer member 80 is employed. Below, the differences are mainly described. Referring to FIG. 10, the second heat transfer member 80 is installed inside the door 20 and transfers heat outside the refrigerator 100 to the heat transfer member 50.

The second heat transfer member 80 may be formed by bending a flat plate member of a heat conductive material, for example, a metal material. At least a part of the second heat transfer member 80, for example one end 81, is located adjacent to the heat transfer member 50. Heat of outside air may be transferred to the second heat transfer member 80 through the door 20 and may be transferred to the heat transfer member 50 through the one end 81 of the second heat transfer member 80.

According to this configuration, heat outside the refrigerator 100 may be directly transferred to the heat transfer member 50 via the second heat transfer member 80. Accordingly, more heat of outside air is transferred to the partition unit, for example, the partition wall 12, and thus, a condensation prevention effect may be improved.

Figure 11:
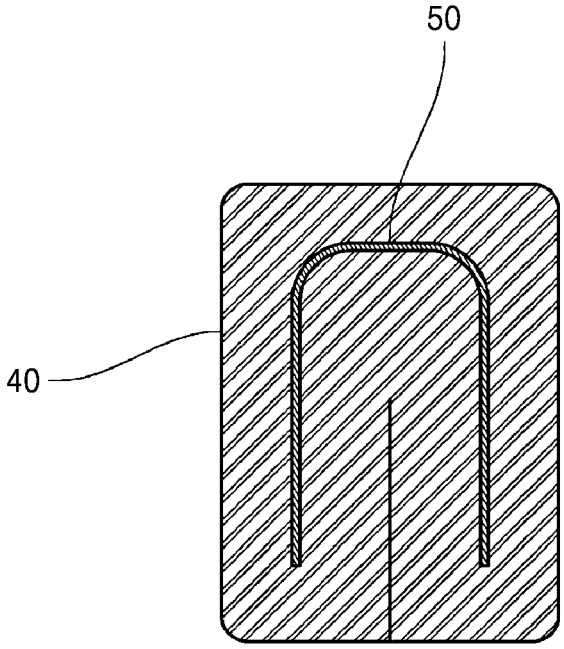
FIG. 11 is a schematic cross-sectional view of the condensation prevention structure according to an embodiment.

In the above-described embodiments, the heat transfer member 50 covers at least a part of an outer surface of the elastic member 40 so that the heat transfer member 50 is directly exposed to the heat of outside air, but the arrangement of the heat transfer member 50 is not limited thereto. FIG. 11 is a schematic cross-sectional view of a condensation prevention structure according to an embodiment. Referring to FIG. 11, the heat transfer member 50 may be installed inside the elastic member 40. In this case, the heat transfer member 50 may be implemented by using a thin metal plate, a metal wire, etc.

In addition, the disclosure is not limited to the above embodiments, and various modifications are possible without departing from the spirit of the disclosure.

The invention claimed is:

1. A refrigerator comprising:

a compartment defined by a partition wall;

a door configured to open and close the compartment;

a gasket on the door so that, when the compartment is closed by the door, the gasket is between the compartment and the door and seals an inside of the compartment;

an elastic member on the door or the compartment so that, when the compartment is closed by the door, the elastic member is between the compartment and the door and is further outside than the gasket; and a heat transfer member in contact with the elastic member and configured so that, when the compartment is closed by the door, the heat transfer member is in contact with the partition wall and the door, and transfers heat of outside air to the partition wall, wherein the elastic member includes a plurality of division elements, and the heat transfer member covers a surface of at least one division element of the plurality of division elements.

2. The refrigerator of claim 1, wherein the heat transfer member covers at least a part of an outer surface of the elastic member.

3. The refrigerator of claim 1, wherein the heat transfer member covers at least a part of an outer surface of the elastic member that is in contact with the outside air.

4. The refrigerator of claim 1, wherein the heat transfer member entirely covers an outer surface of the elastic member.

5. The refrigerator of claim 1, wherein the heat transfer member is inside the elastic member.

6. The refrigerator of claim 1, wherein the plurality of division elements form a layered structure.

7. The refrigerator of claim 6, wherein layer distances of the layered structure are narrower on an outside than an inside of the compartment.

8. A refrigerator comprising:

a compartment defined by a partition wall;

a door configured to open and close the compartment;

a gasket on the door so that, when the compartment is closed by the door, the gasket is between the compartment and the door and seals an inside of the compartment;

an elastic member on the door or the compartment so that, when the compartment is closed by the door, the elastic member is between the compartment and the door and is further outside than the gasket;

a heat transfer member in contact with the elastic member and configured so that, when the compartment is closed by the door, the heat transfer member is in contact with the partition wall and the door, and transfers heat of outside air to the partition wall; and a pocket member including an inner air layer and accommodating the elastic member and the heat transfer member.

9. The refrigerator of claim 8, wherein, when the compartment is closed by the door, the pocket member is in close contact with the door and the partition wall.

10. The refrigerator of claim 8, wherein the pocket member is integrally formed with the gasket.

11. The refrigerator of claim 8, wherein the pocket member is fixed to one of the door and the partition wall.

12. The refrigerator of claim 1, further comprising:

a second heat transfer member inside the door and configured to transfer the heat of the outside air to the heat transfer member.

13. The refrigerator of claim 1, wherein a heat conductivity of the heat transfer member is 100 times or greater than a heat conductivity of the gasket.

* * * * *